US005742927A

United States Patent [19]

Crozier et al.

[11] Patent Number: 5,742,927

[45] Date of Patent: Apr. 21, 1998

[54] NOISE REDUCTION APPARATUS USING SPECTRAL SUBTRACTION OR SCALING AND SIGNAL ATTENUATION BETWEEN FORMANT REGIONS

[75] Inventors: Philip Mark Crozier, Lancashire; Barry Michael George Cheetham, Liverpool, both of United Kingdom

[73] Assignee: British Telecommunications Public Limited Company, England

[21] Appl. No.: 501,055

[22] PCT Filed: Feb. 11, 1994

[86] PCT No.: PCT/GB94/00278

§ 371 Date: Oct. 11, 1995

§ 102(e) Date: Oct. 11, 1995

[87] PCT Pub. No.: WO94/18666

PCT Pub. Date: Aug. 18, 1994

[30] Foreign Application Priority Data

Feb. 12, 1993 [AT] Austria ..... 93301024.1

[51] Int. Cl.[6] ..... G10L 9/04

[52] U.S. Cl. ..... 704/226; 704/219; 704/209; 704/233

[58] Field of Search ..... 395/2.35, 2.42, 395/2.16, 2.17, 2.18, 277; 704/226, 233, 207, 208, 209, 268, 266, 219

[56] References Cited

U.S. PATENT DOCUMENTS

| | | | |
|---|---|---|---|
| 3,180,936 | 4/1965 | Schroeder | 395/2.18 |
| 4,630,304 | 12/1986 | Borth et al. | 395/2.42 |
| 5,133,013 | 7/1992 | Munday | 395/2.35 |
| 5,319,736 | 6/1994 | Hunt | 395/2.36 |
| 5,479,560 | 12/1995 | Mekata | 395/2.18 |

FOREIGN PATENT DOCUMENTS

89/0687 7/1989 United Kingdom .

OTHER PUBLICATIONS

IECON '87 International Conference on Industrial Electronics, Cambridge, Massachusets, USA, vol. 2, pp. 985–996, Nov. 3, 1987.

Niefrt John et al., pp. 985–986, 989, section 2, 4D and 4E. Figure 1, Factors related to spectral subtraction for speech in noise enhancement.

R. Rabiner et al. 1978, New Jersey USA, pp. 449–451, section 8, 10, 2 Digital processing of speech signals.

Bell Systems Technical Journal, Oct. 1981, New York USA, vol. 60, No. 8, pp. 1847–1859, Improving the quality of a noisy speech signal.

Sondhi et al., pp. 1847–1851, Section 1, 2.1, Improving the quality of a noisy speech signal.

International Conference on Acoustics, Speech and Signal Processing, vol. 1, Apr. 7, 1986, pp. 97–100, Japan.

Ariki et al., pp. 99–100, section 5, Acoustic noise reduction by two dimensional spectral smoothing and spectral amplitude transformation.

IECON '87 International Conference on Industrial Electronics Control and Instrumentation, vol. 2, Nov. 3, 1987, Cambridge, Massachusets, USA, pp. 997–1002.

Conway et al., pp. 997–998, section 2.0, 3.0 and 4.0, Adaptive processing with feature extraction to enhance the intelligibility of noise-corrupted speech.

Alta Frequenza, vol. 53, No. 3, May 1984, Milano It, pp. 190–195.

(List continued on next page.)

*Primary Examiner*—Allen R. MacDonald
*Assistant Examiner*—Richemond Dorvil
*Attorney, Agent, or Firm*—Nixon & Vanderhye

[57] ABSTRACT

A noise reduction apparatus and method for enhancing noisy speech signal which applies to the spectral component signals of a time-varying input signal either a spectral substraction process or a spectral scaling process followed by signal attenuation in regions of the frequency spectrum lying between identified formant regions.

49 Claims, 4 Drawing Sheets

OTHER PUBLICATIONS

Audisio et al. pp. 190–192, section 2.1, 2.3. Noisy speech enhancement: a comparative analysis of three different techniques.

Prentice–Hall, Deller et al., "Discrete–Time processing of speech signals", pp. 331–334, 1987.

IEEE Transaction on Acoustics, Speech and Signal Processing, Ahmed, "Comparison of Noisy Speech Enhancement Algorithms in terms of LPC Perturbation", pp. 121–125 vol. 37, Jan. 1989.

IEEE Transactions on Acoustics, Speech, Signal Processing, Boll, "Suppression of Acoustic Noise Speech Using Spectral Subraction", pp. 11–20, vol. ASSP–27, Apr. 1979.

IEEE Transactions on Acoustics, Speech, and Signal Processing, Kang et al., "Quality improvement of LPC–processed noisy speech by using spectral subtraction", pp. 939–942, vol. 37, Jun. 1989.

SPEECH DETECT
NOISE SPECTRUM STORE
C
WINDOW
FFT
**2
Py(ω)
P̂n(ω)
α
P̂s(ω)
INVERSE FFT
OVERLAP
φy(ω)
1
2
3
4
5
6
7
8
9
10
11
12
13

SPEECH DETECT
NOISE SPECTRUM STORE
WINDOW
FFT
**2
Py(ω)
P̂n(ω)
α
P̂s(ω)
H(ω)
INVERSE FFT
OVERLAP
NONLINEAR
LPC SPECTRUM
1
2
3
4
5
6
7
8
9
10
11
12
13
20
21
22

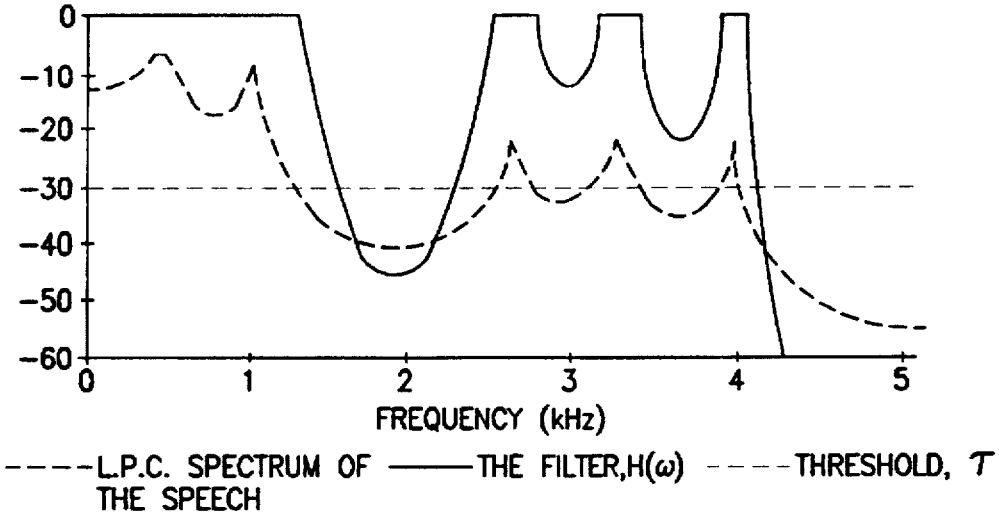
FIG. 3
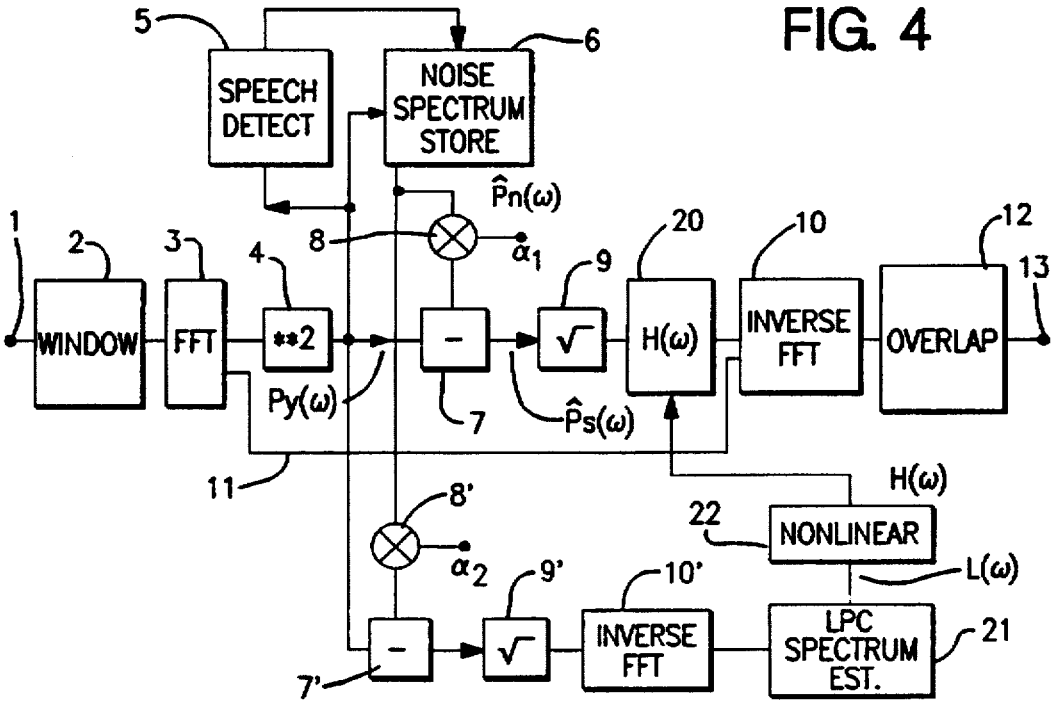

SPEECH DETECT
NOISE SPECTRUM STORE
WINDOW
FFT
**2
Py(ω)
P̂n(ω)
α
P̂s(ω)
H(ω)
INVERSE FFT
OVERLAP
DET
NONLINEAR
L(ω)
LPC SPECTRUM EST.
1
2
3
4
5
6
7
8
9
10
11
12
13
20
21
22
23
2'
3'
4'
5'
6'
7'
8'

GAIN (dB)
30
20
10
0
-10
-20
-30
-40
-50
-60
-70
0
1
2
3
4
5
FREQUENCY (kHz)
1. CORRUPTED SPEECH AFTER S.S
2. CORRUPTED SPEECH AFTER S.S. AND POST PROCESSING

NOISE REDUCTION APPARATUS USING SPECTRAL SUBTRACTION OR SCALING AND SIGNAL ATTENUATION BETWEEN FORMANT REGIONS

BACKGROUND OF THE INVENTION

1. The Field of the Invention

The present invention relates to noise reduction, and more particularly, to a noise reduction apparatus using spectral subtraction or scaling and signal attenuation in the regions of the frequency spectrum lying between the formant regions.

2. Description of the Related Art

Broadband noise when added to a speech signal can impair the quality of the signal, reduce intelligibility, and increase listener fatigue. Since in practice much speech is recorded and transmitted in the presence of noise, the problem of noise reduction is vital to the world of telecommunications, and has gained much attention in recent years.

Various classes of noise reduction algorithms have been developed, including noise suppression filtering, comb filtering, and model based approaches. Known noise suppression techniques include spectral and cepstral subtraction, and Wiener filtering.

Spectral subtraction is a very successful technique for reducing noise in speech signals. This operates (see for example, Boll "Suppression of Acoustic Noise in Speech using Spectral Subtraction", IEEE Trans. or Acoustics, Speech and Signal Processing, Vol. ASSP-27, No. 2, April 1979, p.113) by converting a time domain (waveform) representation of the speech signal into the frequency domain, for example by taking the Fourier transform of segments of speech to obtain a sen of signals representing the short term power spectrum of the speech. An estimate is generated (during speech-free periods ) of the noise power spectrum and these values are subtracted from the speech power spectrum signals; the inverse Fourier transform is then used to reconstruct the time-domain signal from the noise-reduced power spectrum and the unmodified phase spectrum.

A related technique is that of spectral scaling, described by Eger "A Nonlinear Processing Technique for Speech Enhancement" Proc. ICASSP 1983 (IEEE) pp 18A.1.1-18.A.1.4; again the signals are transformed into frequency domain signals which are then multiplied by a nonlinear transfer characteristic so as preferentially to attenuate ion-magnitude frequency components, prior to inverse transformation. Developments of this technique, are described in our international patent application No. PCT/GB89/00049 (published as WO89/06877) or U.S. Pat. No. 5,133,013.

Due to non-stationarity in the noise, the estimated noise spectrum used for spectral subtraction will be different from the actual noise spectrum during speech activity. This error in noise estimation tends to affect small spectral regions of the output, and is perceived as short duration random tones, or musical noise. Whilst much lower in overall energy than the original noise, this musical noise tends to be very irritating to listen to. A similar effect occurs in the case of spectral scaling.

Several methods have been employed in an attempt to minimise the musical noise. Magnitude averaging can be used to reduce these artifacts, although this can result in temporal smearing, due to the non-stationarity of the speech. Another method consists of subtracting an overestimate of the noise spectrum, and preventing the output spectrum from going below a pre-set minimum level. This technique can be very effective, but can lead to greater distortion to the speech.

SUMMARY OF THE INVENTION

According to the present invention there is provided a noise reduction apparatus comprising:

conversion means for converting a time-varying input signal into signals representing the magnitudes of spectral components of the input signals;

processing means operable to effect a reduction in the magnitude of low-magnitude ones of the said spectra component signals relative to that of higher magnitude ones of the said spectral component signals; and reconversion means to convert the said spectral component signals into a time-varying signal;

characterized by means to identify formant regions of the speech spectrum; and means to attenuate those frequency components lying outside the formant regions.

BRIEF DESCRIPTION OF THE DRAWINGS

FIG. 3 is a graph showing the values of a frequency response for a typical linear predictive coding spectrum;

FIG. 4 is another embodiment of the noise reduction apparatus of the present invention including a number of further steps for improving the linear predictive coding estimation;

DESCRIPTION OF THE PREFERRED EMBODIMENTS

Some embodiments of the invention will now be described, by way of example, with reference to the accompanying drawings.

Figure 1:
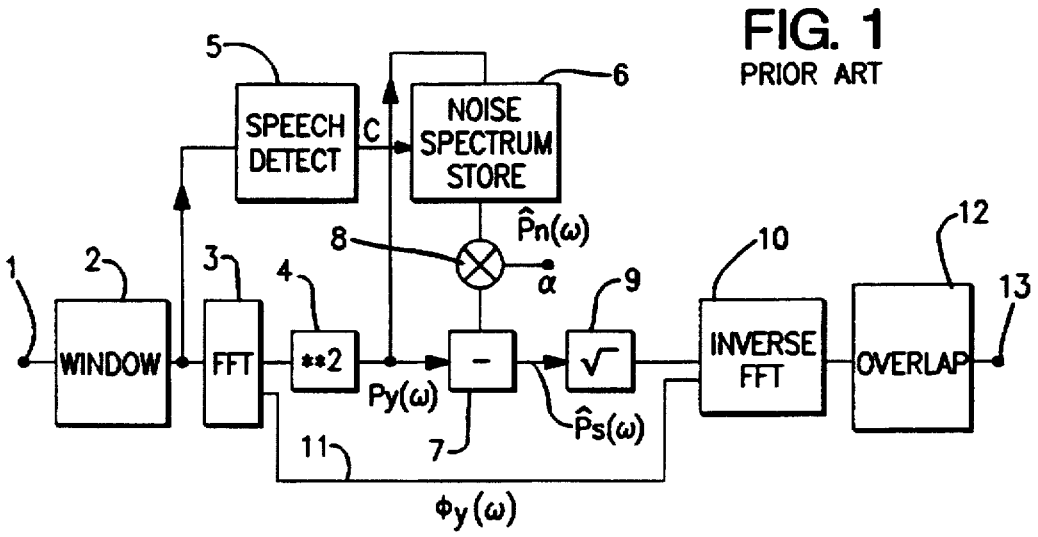
FIG. 1 PRIOR ART
FIG. 1 shows a noise reduction apparatus using spectral subtraction.

The known method of spectral subtraction involves, as illustrated in FIG. 1, subtracting an estimate of the short term noise power spectrum from the short term power spectrum of the speech plus noise. Noisy speech signals, in the form of digital samples at a sampling rate of, for example, 10 kHz are received at an input 1. The speech is segmented at 2 into 50% overlapping Hanning windows of 51 ms duration and a unit 3 generates for each segment a set of Fourier coefficients using a discrete short-time Fourier transform.

If a segment of speech {s(t)} is corrupted by additive noise {n(t)}, Then the corrupted signal {y(t)} can be written as $$y(t)=s(t)+n(t).$$

It can be shown that the short term power spectrum of the corrupted signal, $P_y(\omega)$, can likewise be written as the sum of the noise and speech power spectra, viz.

$$P_y(\omega)=P_s(\omega)+P_n(\omega)$$

If an estimate of the noise power spectrum, $\hat{P}_n(\omega)$, can be obtained, then an approximation $\hat{P}_s(\omega)$ to the speech power spectrum can be obtained from $$\hat{P}_s(\omega)=P_y(\omega)-\hat{P}_n(\omega).$$

The short term power spectrum $P_y(\omega)$ is obtained by squaring at 4 the Fourier coefficients from the unit 3.

The noise spectrum cannot be calculated precisely, but can be estimated during periods when no speech is present in the input signal. This condition is recognized by a voice activity detector 5 to produce a control signal C which permits the updating of a store 6 with $P_y(\omega)$ when speech is absent from the current segment. This spectrum is smoothed, for example by firstly making each frequency sample of $P_y(\omega)$ the average of several surrounding frequency samples, given $\hat{P}_y(\omega)$, the smoothed short term power spectrum of the current frame. With a frame length of 512 samples, the smoothing may for example be performed by averaging nine adjacent samples.

This smoothed power spectrum may then be used to update a spectral estimate of the noise, which consists of a proportion of the previous noise estimate and a proportion of the smoothed short term power spectrum of the current segment. Thus the noise power spectrum gradually adapts to changes in the actual spectrum of the noise. This may be written as $\hat{P}_n(\omega)=\lambda.\hat{P}_{old}(\omega)+(1-\lambda).\hat{P}_y(\omega)$ (3) where $\hat{P}_n(\omega)$ is the updated noise spectral estimate $\hat{P}_{old}(\omega)$ is the old noise spectral estimate, $\hat{P}_y(\omega)$ is the smoothed noise spectrum form the present frame, and $\lambda$ is a decay factor (e.g. a value of $\lambda$=0.85). The contents of the store 6 thus represent the current estimate $\hat{P}_n(\omega)$ of the short term noise power spectrum.

This estimate is subtracted from the noisy speech power spectrum in a subtractor 7. The harshness of the subtraction can be varied by applying a scaling factor $\alpha$ (in a multiplier 8) so that $$\hat{P}_s(\omega)=P_y(\omega)-\alpha.\hat{P}_n(\omega).$$

The scaling factor $\alpha$ would have a value of about 2.3 for standard spectral subtraction, with a signal to noise ratio of 10 dB. A higher value would be used for lower signal to noise ratios. Any resulting negative terms are set to zero, since a frequency component cannot have a negative power; alternatively a non zero minimum power level may be defined, for example defining $\hat{P}_s(\omega)$ as the maximum of $P_y(\omega)-\alpha.\hat{P}_n(\omega)$ and $\beta.\hat{P}_n(\omega)$ where $\beta$ determines the minimum power level or 'spectral floor'. A non zero value of $\beta$ may reduce the effect of musical noise by retaining a small amount of the original noise signal.

After subtraction, the square root of the power terms is taken by a unit 9 to provide corresponding Fourier amplitude components, and the time domain signal segments reconstructed by an inverse Fourier transform unit 10 from these along with phase components $\phi_y(\omega)$ directly from the FFT unit 3 (via a line 11). The windowed speech segments are overlapped in a unit 12 to provide the reconstructed output signal at an output 13.

As already discussed in the introduction, the spectral subtraction technique employed in the apparatus of FIG. 1 has the disadvantage that the output, though less noisy than the input signal, contains musical noise. The majority of information in a segment of noise-free speech is contained within one or more high energy frequency bands, known as formants. In the case of speech corrupted by white additive noise, the musical noise remaining after spectral subtraction is equally likely at all frequencies. It follows that the formant regions of the frequency spectrum will have a local signal-to-noise ratio (s.n.r.) which is higher than the mean s.n.r. for the signal as a whole.

Figure 2:
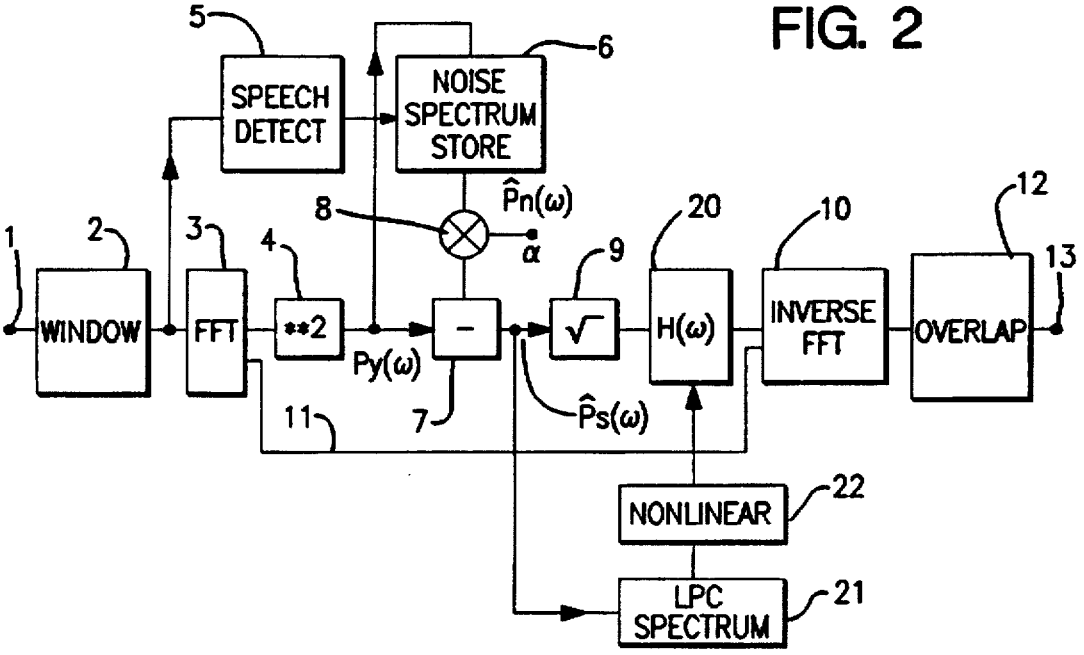
FIG. 2 is an embodiment of the noise reduction apparatus of the present invention using signal attenuation in the regions of the frequency spectrum lying between the formant regions.

Within the formant regions themselves, the musical noise is largely masked out by the speech itself. FIG. 2 illustrates a first embodiment of the present invention which aims to reduce the audible musical noise by attenuating the signal in the regions of the frequency spectrum lying between the formant regions. Attenuation of the regions between the formants has little effect on the perceived quality of the speech itself, so that this approach is able to effect a substantial reduction in the musical noise without significantly distorting the speech.

This attenuation is performed by a unit 20, which multiplies the Fourier coefficients by respective terms of a frequency response $H(\omega)$ (those parts of the apparatus of FIG. 2 having the same reference numerals as in FIG. 1 being as already described).

The response $H(\omega)$ is derived from the L.P.C. (Linear Predictive Coding) spectrum $L(\omega)$ which is obtained by means of a Linear Prediction analysis unit 21. L.P.C. analysis is a well known technique in the field of speech coding and processing and will not, therefore, be described further here. The attenuation operation is such that any coefficient of the spectrally subtracted speech $\hat{P}_s(\omega)$ is attenuated only if the corresponding frequency term of the L.P.C. spectrum is below a threshold value $\tau$. Thus the response $H(\omega)$ is a nonlinear function of $L(\omega)$ and is obtained by a nonlinear processing unit 22 according to the rule:

–if $L(\omega)\geqq\tau$ then $H(\omega)=1$

–if $L(\omega)<\tau$ then $$H(\omega)=\left[\frac{L(\omega)}{\tau}\right]^{\sigma}$$

Preferably the threshold value $\tau$ is a constant for all frequencies and for all speech segments; therefore in a strongly voiced segment of speech, only small portions of the spectrum will be attenuated, whereas in quiet segments most or all of the spectrum may be attenuated. A typical value of about 0.1% of the peak amplitude of the speech is found to work well. A lower value of $\tau$ will produce a more harsh filtering operation. Thus the value could be increased for higher signal to noise ratios, and lowered for lower signal to noise ratios. The power term $\sigma$ is used to vary the harshness of the attenuation; a larger value of $\sigma$ will make the attenuation more harsh. Values of $\sigma$ from 2 to 4 have been found to work well in practice. FIG. 3 is a graph showing the values of $H(\omega)$ for a typical L.P.C. spectrum $L(\omega)$.

As is well known, the L.P.C. analysis is very sensitive to the presence of noise in the speech signal being analyzed. However, the estimation of L.P.C. parameters in the presence of noise is improved by using spectral subtraction prior to the L.P.C. analysis, and for this reason the estimator 21 in FIG. 2 takes as its input the output of the subtractor 7.

Figure 5:
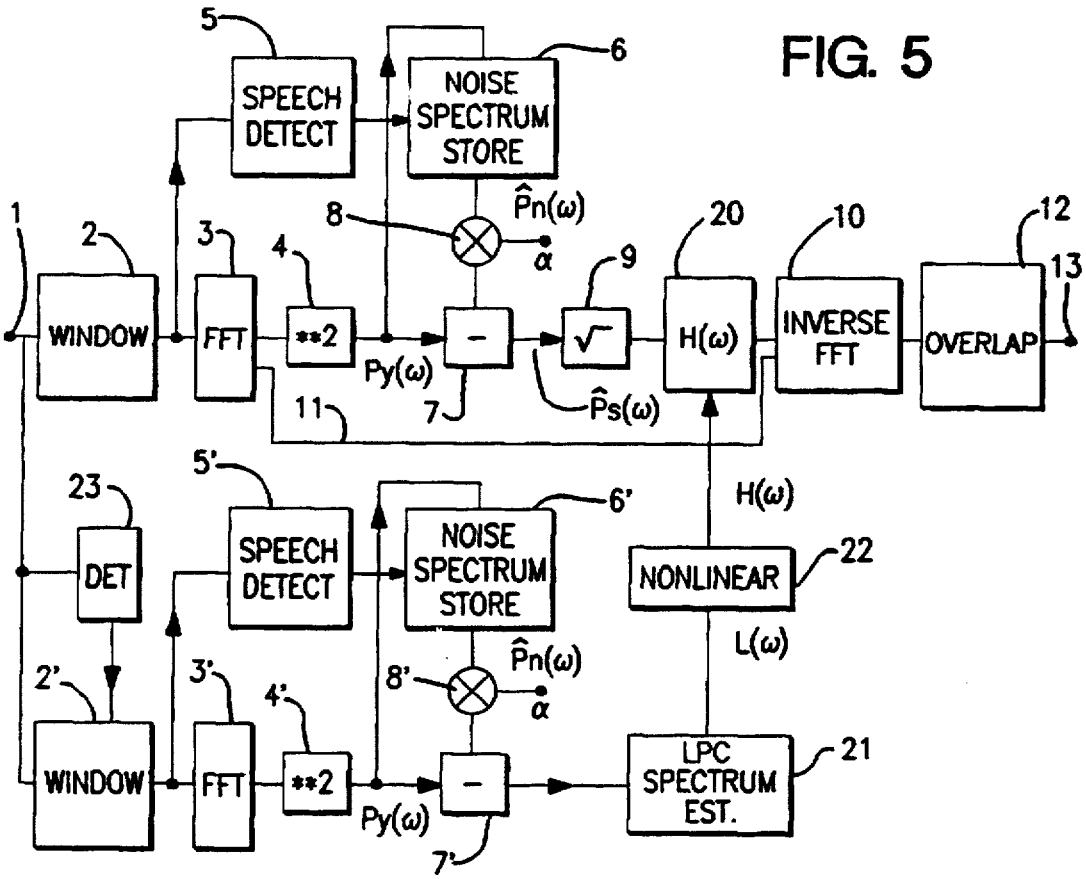
FIG. 5 is another embodiment of the noise reduction apparatus of the present invention which includes an auxiliary spectral substraction arrangement.

When the spectral subtraction is followed by the weighting function $H(\omega)$ a lower value of the scaling factor can be used ($\alpha_1$ in FIG. 4 and 5). A value of 1.5 for a signal to noise ratio of 10 dB has been found to work well.

It has been found that a higher value of $\alpha$ gives better results for the auxiliary spectral subtraction ($\alpha_2$ in FIGS. 4 and 5). (A value of 2.5 has been found to work well at a signal noise ratio of 10 dB); thus in FIG. 4 a separate multiplier $8^1$ and subtractor stage $7^1$, are used to feed the LPC spectrum estimation 21.

As the response $H(\omega)$ is applied to the amplitude terms, and does not affect the phase spectrum $\phi_s(\omega)$, this attenuation is not strictly a filtering operation; though it would in principle be possible to apply filtering by $H(\omega)$ after the inverse Fourier transformation in 10. Alternatively it is also possible to apply the attenuation before the square root (9).

It is noted in passing that the estimation of L.P.C. parameters is not as critical in this context as in coding or recognition applications, since a small error in the bandwidth or frequency of a pole of the filter will affect the filtering only slightly; consequently L.P.C. algorithms generally considered unsuitable for noisy situations may nevertheless be of use here.

However, there are a number of further steps that can be taken to improve the accuracy of the L.P.C. estimation, as will now be described with reference to FIG. 4. When a segment of speech containing uncorrelated noise is analyzed, the contribution of the speech component (as opposed to the noise component) to the results is enhanced by a factor dependent on the segment length. Theory predicts that when the speech is entirely stationary (i.e. $P_s(\omega)$ is not changing with time) the degree of enhancement is proportional to the square root of the segment length. Consequently it is preferable to use, for the spectral subtraction preceding the L.P.C. analysis, a longer segment length when the speech is stationary. Thus the apparatus of FIG. 5 includes an auxiliary spectral subtraction arrangement comprising units 2' to 8' which are identical to units 2 to 8 in all respects except for the segment length. The L.P.C. estimator 21 now takes its input from the auxiliary subtractor 7'.

The speech is divided into stationary sections and the segment length adjusted to match. A further unit 23 monitors the stationarity of the input speech signal and provides to the windowing unit 2' (and units 3' to 8', via connections not illustrated) a control signal CSL indicating the segment length that is to be used. Tests have indicated that a typical range of segment length variation is from 38 to 205 ms.

The mode of operation of the detector 23 might be as follows:

(i) The LP spectrum of the central 25 ms of the present frame of noisy speech is calculated.

(ii) LP spectra of neighboring 25 ms portions are also calculated, and spectral distances between the central LP spectrum and the neighboring LP spectra are calculated.

(iii) Any neighboring 25 ms portions judged sufficiently similar to the present portion are included in the 'stationary section'. A maximum of four 25 ms segments forward and back from the present portion are used. Thus stationary sections might range in length from 25 ms to 225 mS, and will not necessarily be centred around the present windowed frame.

(iv) Spectral subtraction is then performed on the stationary section as a whole, and the LP spectral estimate is calculated.

Additionally, it is found that L.P.C. parameters derived from spectrally subtracted speech tend to move the poles of the response—compared with the true positions that would be obtained by analysing a noise-free version of the speech—towards the unit circle (i.e. the opposite of what occurs when L.P.C. parameters are calculated directly from noisy speech). This effect can be mitigated by damping the parameters prior to calculation of the L.P.C. spectrum $L(\omega)$. Thus the L.P.C. estimation unit 21 in FIG. 5 proceeds by:

(i) deriving the coefficients a ($1 \leqq i \leqq p$) of an L.P.C. filter of order p.

(ii) Damping the coefficients using the transformation $a_i' = a_i . \sigma$ where $\sigma$ is a constant less than unity (e.g. 0.97).

(iii) Computing the filter response $L(\omega)$ from the damped coefficients $a_i'$.

Figure 6:
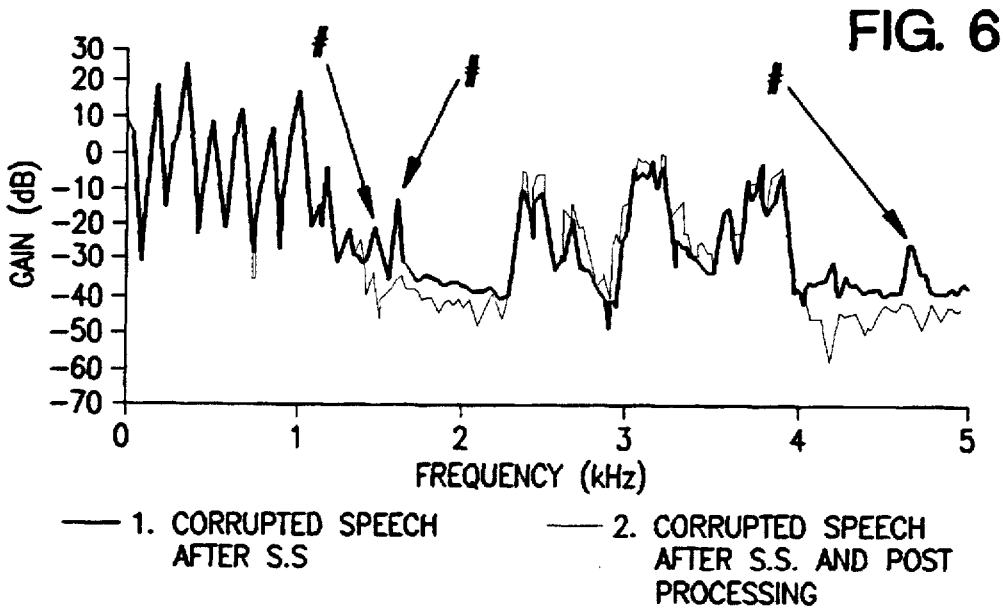
FIG. 6 shows graphically a comparison of the results obtained with the apparatus of FIG. 5.

FIG. 6 shows graphically a comparison of the results obtained.

The first plot shows a short term spectrum of the corrupted vowel sound 'o' from the word 'hogs' after enhancement by spectral subtraction. The second plot shows the same frame of corrupted speech after spectral subtraction followed by the post processing algorithm. The peaks marked # in the first plot have been removed by the spectral weighting function in the second plot. It can be shown that these peaks are uncorrelated with the speech, and are the cause of the musical noise. Secondly, the attenuation of the lower amplitude formants is greater in the first plot, due to higher value of $\alpha$, leading to more distorted speech.

Figure 7:
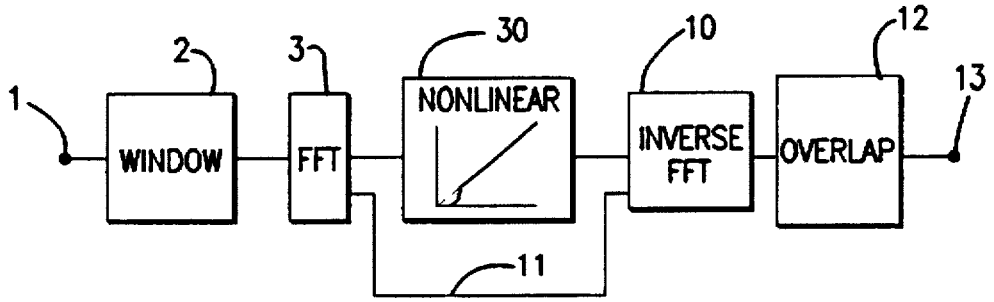
FIG. 7 shows a spectral scaling apparatus used in a further embodiment of the present invention.

A further embodiment of the invention employs spectral scaling rather than spectral subtraction. FIG. 7 shows the basic principle of this, where the transformed coefficients are subjected to processing (in unit 30) by a nonlinear transfer characteristic which progressively attenuates lower intensity spectral components (assumed to consist mainly of noise) but passes higher intensity spectral components relatively unattenuated. As described by Munday (U.S. Pat. No. 5,133,013) different transfer characteristics may be used for different frequency components, and/or level automatic gain control or other arrangements may by provided for scaling the nonlinear characteristic according to signal amplitude.

Figure 8:
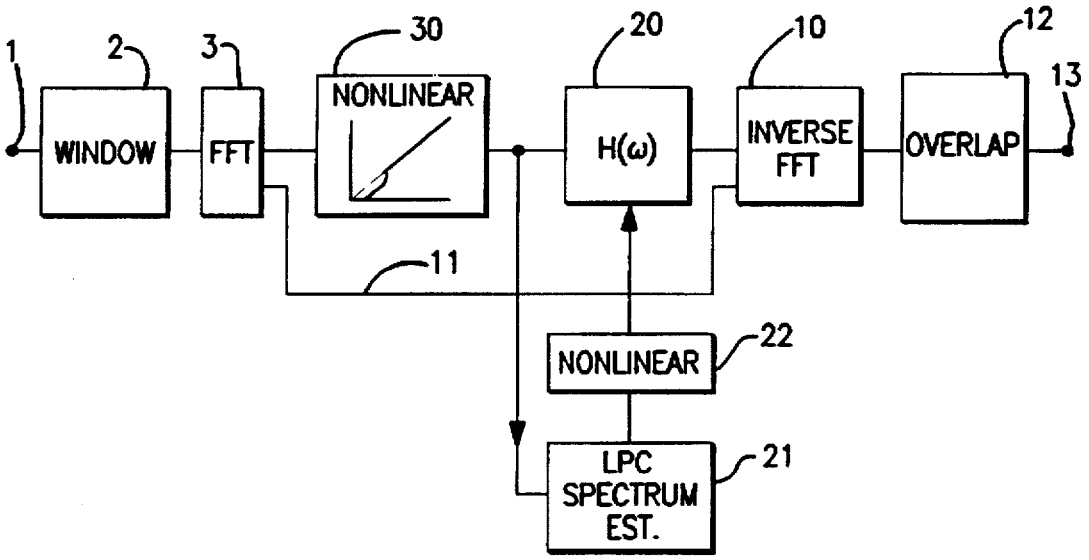
FIG. 8 shows an embodiment of the present invention using spectral scaling and spectral subtraction.

Spectral attenuation as envisaged by the present invention may be employed in this case also, as shown in FIG. 8 where the unit 20 is inserted between the nonlinear processing 20 and the inverse FFT unit 10. As in the case of FIG. 4, the response $H(\omega)$ is provided by an L.P.C. estimation unit 21 and nonlinear unit 22, which function as described above, save that the input to the spectrum estimation is now obtained from the nonlinear processing stage 30. Analogously to the case of the apparatus of FIG. 4 or 5, this input may be obtained from an auxiliary spectral scaling arrangement having a different value of $\alpha$ and/or a different, or adaptively variable segment length.

It should be noted that the preprocessing for the L.P.C. spectrum estimation and the main spectral subtraction or scaling do not necessarily have to be of the same type; thus, if desired, the apparatus of FIG. 5 could utilize spectral scaling to feed the L.P.C. analysis unit 21, or the apparatus of FIG. 8 could employ spectral subtraction.

We claim:

1. A noise reduction apparatus comprising:

conversion means for converting a time-varying input signal into spectral component signals representing the magnitudes of spectral components of the input signals;

processing means for applying to said spectral component signals a spectral subtraction process;

reconversion means for converting said spectral component signals into a time-varying signal;

means for identifying formant regions of the speech spectrum; and means for effecting, at a predetermined point after said application of said subtraction process, further attenuation of those frequency components lying outside the formant regions.

2. A noise reduction apparatus according to claim 1 in which the conversion means is operable to perform a discrete Fourier transform on segments of the input signal.

3. A noise reduction apparatus according to claim 1 further comprising means for recognizing periods during which speech is absent from the input signal and storing signals representing the power spectrum of the input signal during such periods to represent an estimated noise spectrum of the input signal, and wherein the processing means performing the spectral subtraction process subtracts from signals representing the power spectrum of the input signal, the signals representing an estimated noise spectrum of the input signal.

4. A noise reduction apparatus according to claim 1 in which the means to identify formant regions is responsive to the input signal or a derivative of said input signal to produce frequency response signals, and in which the attenuation means is operable to multiply the power spectrum of the signal by the frequency response signals.

5. A noise reduction apparatus according to claim 4 in which the means to identify formant regions includes Linear Predictive Analysis means to produce a linear predictive (LP) spectrum.

6. A noise reduction appartus according to claim 5 in which the means to identify formant regions includes thresholding means such that the frequency response signals are unity wherever the LP spectrum is above a threshold value and otherwise are a function of the LP spectrum.

7. A noise reduction apparatus according to claim 4, in which the means to identify formant regions is responsive to the output of the processing means.

8. A noise reduction apparatus according to claim 4 in which the means to identify the formant regions is responsive to the spectral component signals following processing by auxiliary processing means operable to apply the spectral subtraction process to said spectral component signals.

9. A noise reduction apparatus according to claim 4 further comprising auxiliary conversion means for converting the time-varying input signal into further spectral component signals representing the magnitudes of spectral components of the input signals and auxiliary processing means operable to apply the spectral substraction process to said further spectral component signals; and in which the means to identify the formant regions is responsive to the output of the auxiliary processing means.

10. A noise reduction apparatus according to claim 9 in which the conversion means is operable to produce said spectral component signals for each of successive fixed time periods of the input signal and the auxiliary conversion means is operable to produce said further spectral component signals for each successive time period of speech, those periods having durations differing from the said fixed time periods.

11. A noise reduction apparatus according to claim 10 further comprising means for monitoring the stationarity of the input speech signal and to control the duration of the time periods employed by the auxiliary conversion means.

12. A noise reduction apparatus comprising:

conversion means for converting a time-varying input signal into signals representing the magnitudes of spectral components of the input signals;

processing means operable to effect a reduction in the magnitude of low-magnitude ones of the said spectral component signals relative to that of higher magnitude ones of the said spectral component signals;

reconversion means to convert the said spectral component signals into a time-varying signal;

means to identify format regions of the speech spectrum;

means to attenuate those frequency components lying outside the formant regions;

the means to identify formant regions being responsive to the input signal or a derivative of the input signal to produce frequency response signals, and the attenuation means being operable to multiply the power spectrum of the signal by the frequency response signals;

the means to identify formant regions including Linear Predictive Analysis means to produce a linear predictive (LP) spectrum; and thresholding means such that the frequency response signals are unity wherever the LP spectrum is above a threshold value and otherwise are a function of the LP spectrum.

13. A noise reduction apparatus comprising:

conversion means for converting a time-varying input signal into signals representing the magnitudes of spectral components of the input signals;

processing means operable to effect a reduction in the magnitude of low-magnitude ones of the said spectral component signals relative to that of higher magnitude ones of the said spectral component signals;

reconversion means to convert the said spectral component signals into a time-varying signal;

means to identify format regions of the speech spectrum;

means to attenuate those frequency components lying outside the formant regions;

the means to identify formant regions being responsive to the input signal or a derivative of the input signal to produce frequency response signals, and the attenuation means being operable to multiply the power spectrum of the signal by the frequency response signals;

the means to identify the formant regions being further responsive to the spectral signals following processing by auxiliary processing means operable to effect a reduction in the magnitude of low magnitude ones of the said spectral component signals relative to that of higher magnitude ones of the said spectral component signals.

14. A noise reduction apparatus comprising:

conversion means for converting a time-varying input signal into signals representing the magnitudes of spectral components of the input signals;

processing means operable to effect a reduction in the magnitude of low-magnitude ones of the said spectral component signals relative to that of higher magnitude ones of the said spectral component signals;

reconversion means to convert the said spectral component signals into a time-varying signal;

means to identify format regions of the speech spectrum;

means to attenuate those frequency components lying outside the formant regions;

the means to identify formant regions being responsive to the input signal or a derivative of the input signal to produce frequency response signals, and the attenuation means being operable to multiply the power spectrum of the signal by the frequency response signals;

auxiliary conversion means for converting the time-varying input signal into signals representing the magnitudes of spectral components of the input signals and auxiliary processing means operable to effect a reduction in the magnitude of low-magnitude ones of the said spectral component signals relative to that of higher magnitude ones of the said spectral component signals; and in which the means to identify the formant regions is responsive to the output of the auxiliary processing means.

15. A noise reduction apparatus according to claim 14 in which the conversion means is operable to produce said spectral component signals for each of successive fixed time periods of the input signal and the auxiliary conversion means is operable to produce said further spectral component signals for each successive time period of speech, those periods having durations differing from the said fixed time periods.

16. A noise reduction apparatus according to claim 15 including means for monitoring the stationarity of the input speech signal and to control the duration of the time periods employed by the auxiliary conversion means.

17. A noise reduction apparatus comprising:

conversion means for converting a time-varying input signal into spectral component signals representing the magnitudes of spectral components of the input signals;

processing means for applying to said spectral component signals a spectral scaling process;

reconversion means for converting said spectral component signals into a time-varying signal;

means for identifying formant regions of the speech spectrum;

means for effecting, at a predetermined point after said application of said scaling process, further attenuation of those frequency components lying outside the formant regions.

18. A noise reduction apparatus according to claim 17 in which the conversion means is operable to performs a discrete Fourier transform on segments of the input signal.

19. A noise reduction apparatus according to claim 17 in which the processing means performing the spectral scaling process applies to said spectral component signals a non-linear transfer characteristic such as to attenuate low magnitude spectral component signals relative to high magnitude ones.

20. A noise reduction apparatus according to claim 17 in which the means for identifying formant regions is responsive to the input signal or a derivative of said input signal to produce frequency response signals, and the attenuation means is operable to multiply the power spectrum of the signal by the frequency response signals.

21. A noise reduction apparatus according to claim 20 in which the means to identify formant regions includes Linear Predictive Analysis means to produce a linear predictive (LP) spectrum.

22. A noise reduction apparatus according to claim 21 in which the means for identifying formant regions includes thresholding means such that the frequency response signals are unity wherever the LP spectrum is above a threshold value and otherwise are a function of the LP spectrum.

23. A noise reduction apparatus according to claim 20 in which the means to identify formant regions is responsive to the output of the processing means.

24. A noise reduction apparatus according to claim 20 in which the means to identify the formant regions is responsive to the spectral component signals following processing by auxiliary processing means operable to apply the spectral scaling process to said spectral component signals.

25. A noise reduction apparatus according to claim 20 further comprising auxiliary conversion means for converting the time-varying input signal into further spectral component signals representing the magnitudes of spectral components of the input signals and auxiliary processing means operable to apply the spectral scaling process to said further spectral component signals; and in which the means to identify the formant regions is responsive to the output of the auxiliary processing means.

26. A noise reduction apparatus according to claim 25 in which the conversion means is operable to produce said spectral component signals for each of successive fixed time periods of the input signal and the auxiliary conversion means is operable to produce said further spectral component signals for each successive time period of speech, those periods having durations differing from the said fixed time periods.

27. A noise reduction apparatus according to claim 26 further comprising means for monitoring the stationarity of the input speech signal and to control the duration of the time periods employed by the auxiliary conversion means.

28. A method for reducing noise comprising:

converting a time-varying input signal into spectral component signals representing the magnitudes of spectral components of the input signals;

applying to said spectral component signals a spectral subtraction process;

identifying formant regions of the speech spectrum;

effecting, at a predetermined point after said application of said subtraction process, further attenuation of those frequency components lying outside the formant regions; and reconverting said spectral component signals into a time-varying signal.

29. A method for reducing noise according to claim 28 in which:

the step of converting a time-varying input signal into spectral component signals is performed using a discrete Fourier transform on segments of the input signal.

30. A method for reducing noise according to claim 28 further comprising the steps of:

recognizing periods during which speech is absent from the input signal and storing signals representing the power spectrum of the input signal during such periods to represent an estimated noise spectrum of the input signal, and performing the spectral subtraction process subtraction from signals representing the power spectrum of the input signal, the signals representing an estimated noise spectrum of the input signal.

31. A method for reducing noise according to claim 28 in which:

the step of identifying formant regions further comprises producing frequency response signals in response to the input signal or a derivative of said input signal, and the step of effecting further attenuation further comprises multiplying the power spectrum of the signal by the frequency response signals.

32. A method for reducing noise according to claim 31 in which the step of identifying formant regions includes using Linear Predictive Analysis to produce a linear predictive (LP) spectrum.

33. A method for reducing noise according to claim 32 in which the step of identifying formant regions further comprises:

setting the frequency response signals to be unity wherever the LP spectrum is above a predetermined threshold value and otherwise to be a function of the LP spectrum.

34. A method for reducing noise according to claim 31 in which:

the step of identifying formant regions is responsive to applying said spectral subtraction process to said spectral component signals.

35. A method for reducing noise according to claim 31 in which:

the step of identifying the formant regions is responsive to said spectral component signals following application of the spectral subtraction process to said component signals.

36. A method for reducing noise according to claim 31 further comprising the steps of:

converting the time-varying input signal into further spectral component signals representing the magnitudes of spectral components of the input signals; and applying the spectral subtraction process to said further spectral component signals; and in which the step of identifying the formant regions is responsive to the output of converting the time-varying input signal into said further spectral component signals.

37. A method for reducing noise according to claim 36 in which the step of converting the time-varying input signal into spectral component signals further includes:

producing said spectral component signals for each of successive fixed time periods of the input signal, and in which the step of converting the time-varying input signal into further spectral component signals further includes producing said further spectral component signals for each successive time period of speech, those periods having durations differing from the said fixed time periods.

38. A method for reducing noise according to claim 37 further comprising:

monitoring the stationarity of the input speech signal and controlling the duration of the time periods employed in the step of producing said spectral component signals for each of successive fixed time periods of the input signal.

39. A method for reducing noise comprising:

converting a time-varying input signal into spectral component signals representing the magnitudes of spectral components of the input signals;

applying to said spectral component signals a spectral scaling process;

identifying formant regions of the speech spectrum;

effecting, at a predetermined point after said application of said subtraction process, further attenuation of those frequency components lying outside the formant regions; and reconverting said spectral component signals into a time-varying signal.

40. A method for reducing noise according to claim 39 in which:

the step of converting a time-varying input signal into spectral component signals is performed using a discrete Fourier transform on segments of the input signal.

41. A method for reducing noise according to claim 39 in which the step of performing the spectral scaling process further comprises:

applying to said spectral component signals a nonlinear transfer characteristic to attenuate low magnitude spectral component signals relative to high magnitude ones.

42. A method for reducing noise according to claim 39 in which the step of identifying formant regions further comprises:

producing frequency response signals in response to the input signal or a derivative of said input signal, and the step of effecting further attenuation further comprises multiplying the power spectrum of the signal by the frequency response signals.

43. A method for reducing noise according to claim 42 in which:

the step of identifying formant regions includes using Linear Predictive Analysis to produce a linear predictive (LP) spectrum.

44. A method for reducing noise according to claim 43 in which the step of identifying formant regions further comprises:

setting the frequency response signals to be unity wherever the LP spectrum is above a predetermined threshold value and otherwise to be a function of the LP spectrum.

45. A method for reducing noise according to claim 42 in which:

the step of identifying formant regions is responsive to applying said spectral scaling process to said spectral component signals.

46. A method for reducing noise according to claim 42 in which:

the step of identifying the formant regions is responsive to said spectral component signals following application of the spectral scaling process to said component signals.

47. A method for reducing noise according to claim 42 further comprising the steps of:

converting the time-varying input signal into further spectral component signals representing the magnitudes of spectral components of the input signals; and applying the spectral scaling process to said further spectral component signals; and in which the step of identifying the formant regions is responsive to said converting the time-varying input signal into said further spectral component signals.

48. A method for reducing noise according to claim 47 in which:

the step of converting the time-varying input signal into spectral component signals further includes producing said spectral component signals for each of successive fixed time periods of the input signal, and the step of converting the time-varying input signal into further spectral component signals further includes producing said further spectral component signals for each successive time period of speech, those periods having durations differing from said fixed time periods.

49. A method for reducing noise according to claim 48 further comprising:

monitoring the stationarity of the input speech signal and controlling the duration of the time periods employed in the step of producing said spectral component signals for each of successive fixed time periods of the input signal.

* * * * *